US009073016B2

(12) United States Patent
Alenzi

(10) Patent No.: US 9,073,016 B2
(45) Date of Patent: Jul. 7, 2015

(54) ROTATING DISC AERATOR

(71) Applicant: Bader Shafaqa Alenzi, Abdulla Almubarek (KW)

(72) Inventor: Bader Shafaqa Alenzi, Abdulla Almubarek (KW)

( * ) Notice: Subject to any disclaimer, the term of this patent is extended or adjusted under 35 U.S.C. 154(b) by 271 days.

(21) Appl. No.: 13/891,118

(22) Filed: May 9, 2013

(65) Prior Publication Data

US 2014/0332989 A1 Nov. 13, 2014

(51) Int. Cl.

| | |
|---|---|
| ***B01F 3/04*** | (2006.01) |
| ***B01F 7/00*** | (2006.01) |
| ***B01F 13/00*** | (2006.01) |
| ***B01F 15/00*** | (2006.01) |

(52) U.S. Cl.

CPC ..... *B01F 7/00033* (2013.01); *B01F 7/0005* (2013.01); *B01F 13/0049* (2013.01); *B01F 15/00006* (2013.01); *B01F 3/04765* (2013.01)

(58) Field of Classification Search

CPC ..... C02F 3/08
USPC ..... 261/83, 94, 95, 99; 210/219
See application file for complete search history.

(56) References Cited

U.S. PATENT DOCUMENTS

| | | | | |
|---|---|---|---|---|
| 1,703,967 | A | | 3/1929 | Sperr, Jr. |
| 1,717,713 | A | | 6/1929 | Logan |
| 1,854,492 | A | | 4/1932 | Sperr, Jr. |
| 2,805,897 | A | | 9/1957 | Yellott |
| 3,341,450 | A | | 9/1967 | Ciabattari et al. |
| 4,364,826 | A | * | 12/1982 | Kato ..... 210/150 |
| 5,779,885 | A | * | 7/1998 | Hickok et al. ..... 210/150 |
| 2003/0030157 | A1 | * | 2/2003 | Petrescu et al. ..... 261/92 |
| 2003/0155306 | A1 | | 8/2003 | Bourke |
| 2007/0251865 | A1 | | 11/2007 | Bresolin |

FOREIGN PATENT DOCUMENTS

| | | |
|---|---|---|
| GB | 2096908 | 10/1982 |

* cited by examiner

*Primary Examiner* — Duane Smith
*Assistant Examiner* — Adam W Bergfelder
(74) *Attorney, Agent, or Firm* — Richard C Litman

(57) ABSTRACT

The rotating disc aerator is a portable aeration device utilizing atmospheric air, rather than using a compressor for its air supply. The aerator includes a motorized base having a rotary shaft and diametrically opposed, oppositely reciprocating rods extending therefrom. A plurality of discs are disposed along the shaft and are connected to the ends of the rods. The discs are free to slide along the shaft as the rods reciprocate, but rotate with the shaft. A plurality of resilient absorbent elements (sponges, etc.) are installed along the rotary shaft between the discs. The aerator assembly is buoyant, about one-half of each absorbent element extending above the surface of the water when the aerator is placed therein. The upper portions of the absorbent elements absorb air as they rotate above the surface, and are compressed to expel the air into the water as they rotate beneath the water surface.

19 Claims, 6 Drawing Sheets

ROTATING DISC AERATOR

BACKGROUND OF THE INVENTION

1. Field of the Invention

The present invention relates generally to water aeration devices, and particularly to a portable rotating disc aerator having a plurality of oppositely reciprocating resilient elements of open cell absorbent material disposed along a rotary shaft for absorbing air and dispensing the air beneath the surface of the water.

2. Description of the Related Art

Water is aerated for a wide variety of purposes, e.g., providing oxygenated water for aquarium use, introducing dissolved oxygen in water for aerobic bacteria in sewage processing, and other operations. Conventional aeration uses permanently installed, porous air pipes or ducts that are submerged within the body of water being treated. The air is supplied by adjacent compressors and expelled from the porous pipes to bubble up through the water. Such systems are reasonably practical for relatively small aquaria and the like, but become quite costly in terms of initial cost and the cost of operation and maintenance when considering an installation in a relatively large body of water, such as a sewage treatment plant or the like. Moreover, such systems are clearly not portable and cannot be temporarily installed in a natural body of water in response to a disaster, such as wastewater contamination, etc.

Thus, a rotating disc aerator device solving the aforementioned problems is desired.

SUMMARY OF THE INVENTION

The rotating disc aerator is a portable unit including a motorized base having a rotary shaft extending therefrom. Two diametrically opposed oppositely reciprocating rods extend from the base. The rotary shaft is between the two rods. A plurality of discs is disposed along the central shaft. The discs are rotationally locked to the rotation of the shaft, but free to slide longitudinally along the shaft. A ring is secured about the circumference of each disc, so that each respective disc is free to rotate within its ring. Each ring is secured to the distal end of one of the two reciprocating rods. Thus, the rods slide the discs back and forth along the rotary shaft, while the shaft rotates the discs within their rings.

A plurality of resilient, absorbent open-cell elements, e.g., foam plastic, sponge, etc., is secured along the central rotary shaft and between the discs. The absorbent material is rotationally locked to the discs, and thus to the rotary shaft. The entire apparatus is provided with sufficient buoyancy that the linear array of absorbent material floats upon the surface of the water, approximately half of the diameter of the absorbent elements being submerged and half being above the water. The motorized body is ballasted in order to maintain proper orientation in the water. As the central shaft and the discs rotationally affixed thereto rotate, the absorbent material is alternately exposed to the air and submerged beneath the surface of the water. Simultaneously with the above operation, the discs are reciprocated along the rotary shaft by the reciprocating rods to compress and expand the resilient absorbent elements. The simultaneous rotation, expansion, and contraction of the resilient absorbent elements results in air and water being absorbed as they expand and the air being expelled beneath the surface as the water is expelled above the surface as they contract after about 180° of rotation.

In an alternative embodiment, the absorbent elements have a semicylindrical configuration. The semicylindrical elements are alternately exposed to the air and submerged beneath the surface of the water. The elements are expanded as they are exposed to the air and contracted as they are submerged, thus substantially precluding their absorption of water. Another alternative embodiment includes a plurality of spray or rinse nozzles and a spray shield disposed above the absorbent elements to wash contaminants from the absorbent elements as they rotate above the surface of the water.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The rotating disc aerator is a portable device capable of rapid placement in a body of water for the aeration thereof in the event of an environmental emergency, e.g., contamination of a body of water due to sewage or wastewater spill, etc. The aerator is self-contained and does not require any additional external air supply from a compressor or the like. Rather, the rotating disc aerator draws air from the atmosphere and expels that air beneath the surface of the water to aerate the water.

Figure 1:
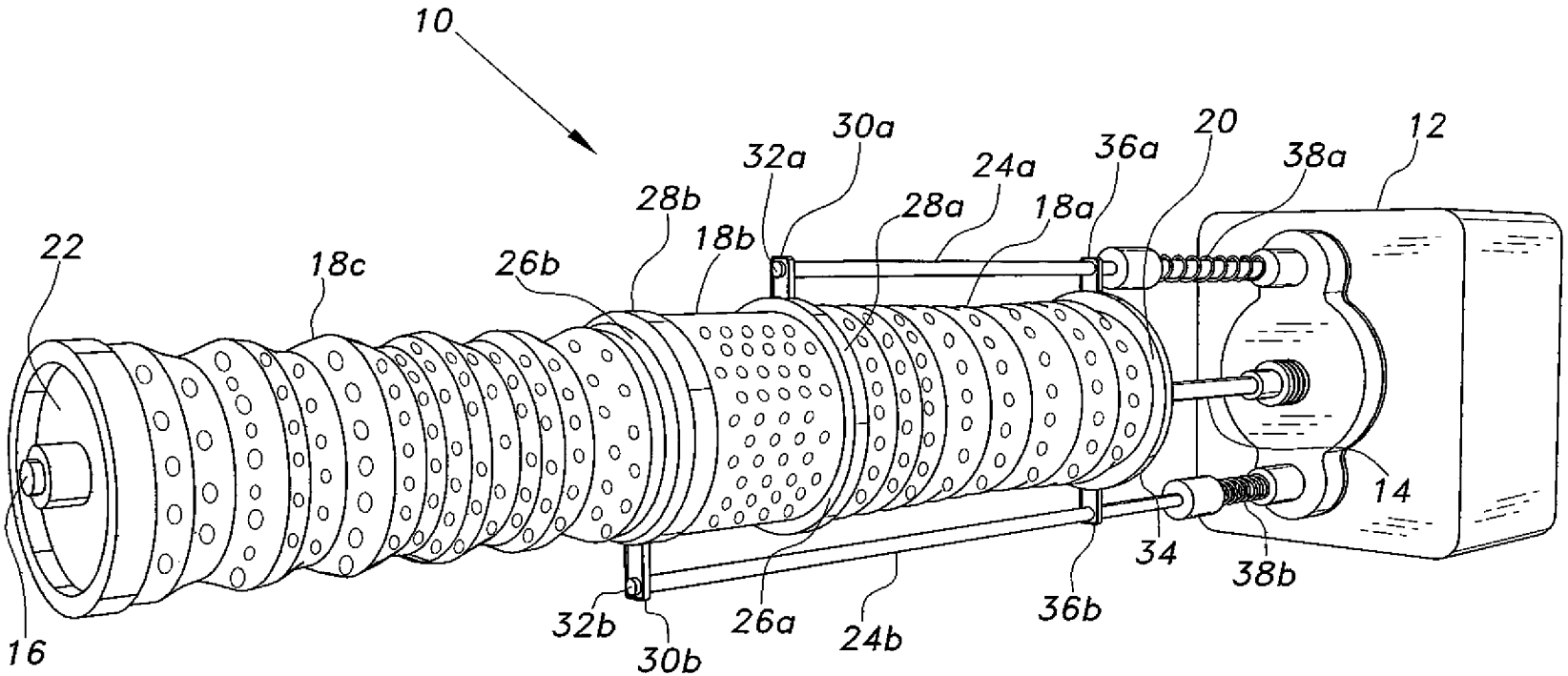
FIG. 1 is a perspective view of a rotating disc aerator according to the present invention, illustrating its general features.
Figure 2A:
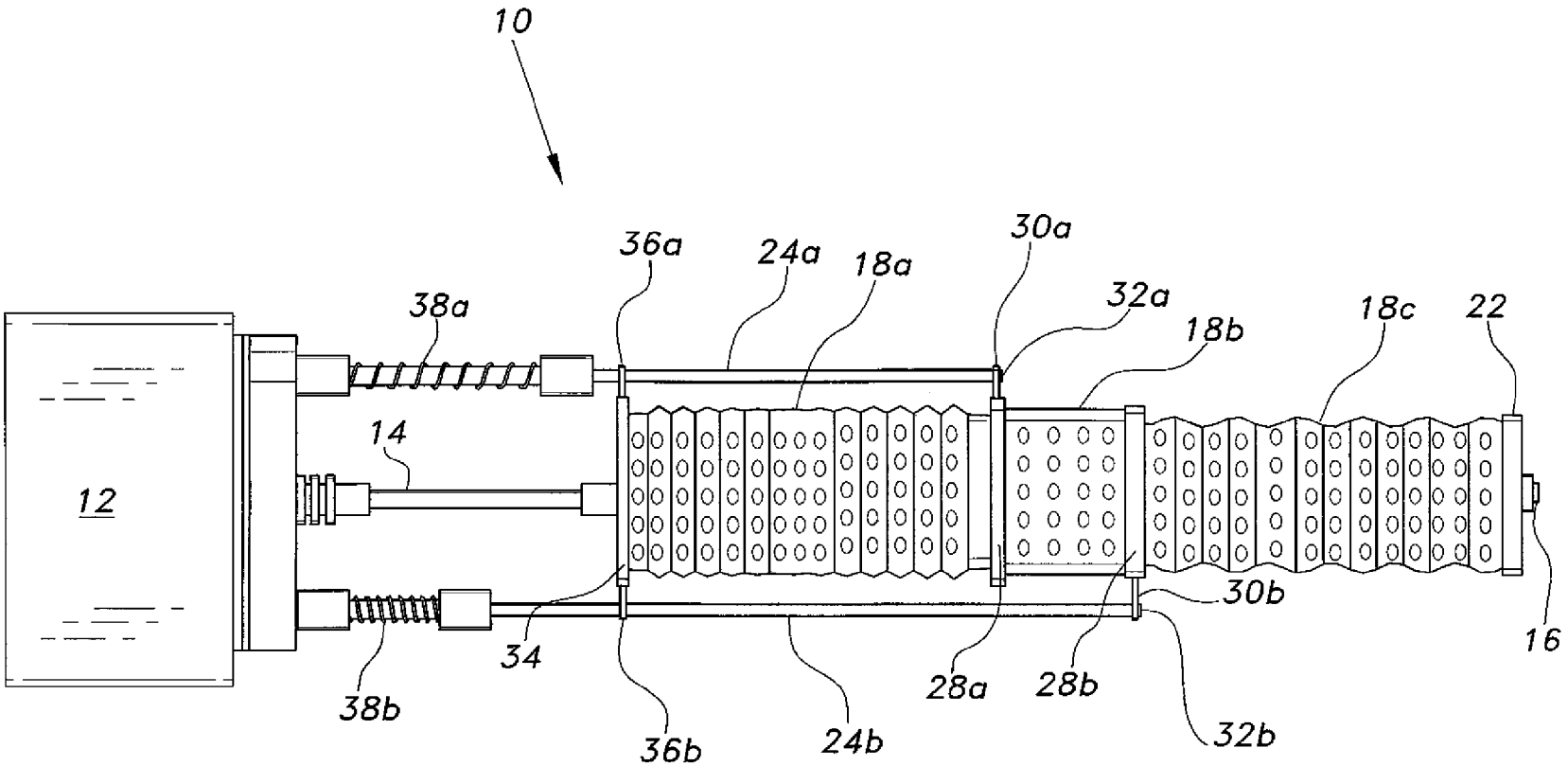
FIG. 2A is a side elevation view of the rotating disc aerator of FIG. 1, showing the central resilient element in a compressed condition and the opposite end elements in expanded conditions.
Figure 2B:
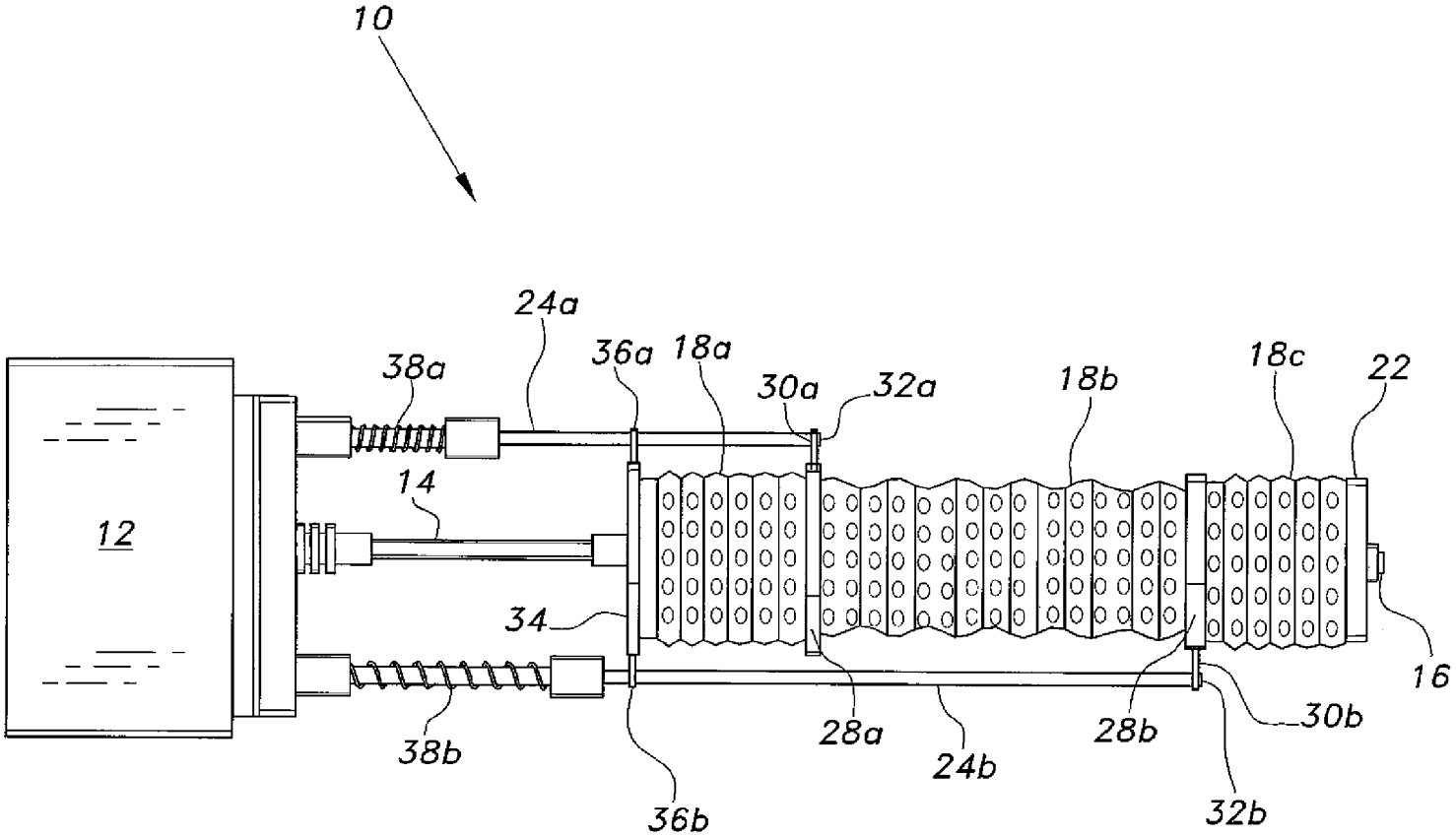
FIG. 2B is a side elevation view of the rotating disc aerator of FIG. 1, showing the central element in an expanded condition and the opposite end elements in compressed conditions.
Figure 3:
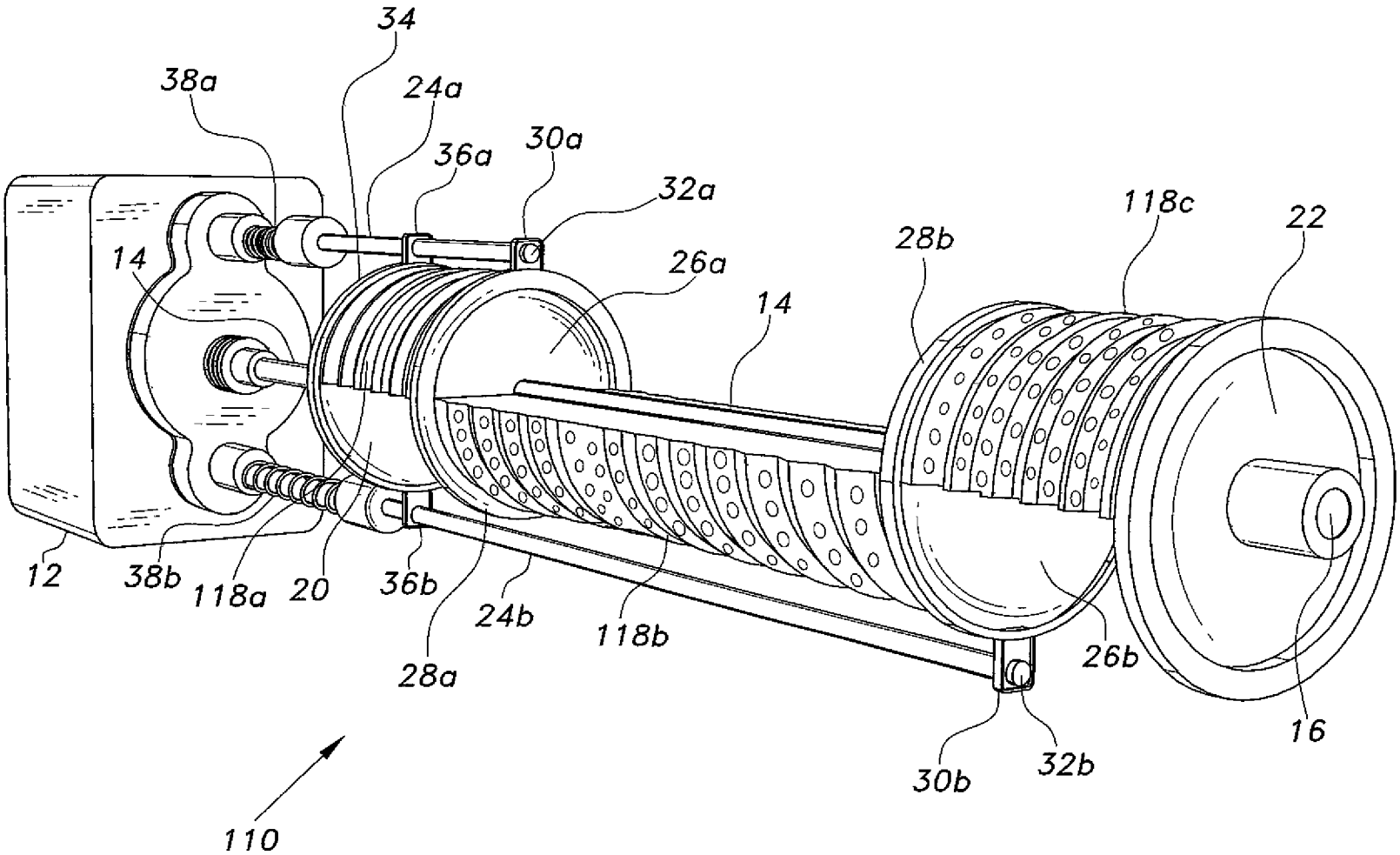
FIG. 3 is a perspective view of an alternative embodiment of a rotating disc aerator according to the present invention, illustrating various features thereof.

FIG. 1 of the drawings provides a perspective view of a first embodiment of the rotating disc aerator 10, and FIGS. 2 and 3 provide side elevation views showing the reciprocating operation of the device to expand and contract the resilient open cell absorbent elements of the device. The aerator 10 includes a motorized body 12 containing conventional means for driving the moving components of the device (e.g., electric motor, etc.) and energy storage (e.g., electrical storage cells or battery, etc.) to provide power for the operation of the device. The motorized body 12 is sealed to provide a waterproof enclosure for the drive components therein, and is preferably provided with sufficient volume to provide buoyancy for that portion of the device. The motorized body 12 is preferably ballasted in order to maintain a constant orientation in the water, for reasons that will become apparent further below. This may be accomplished by placement of the electrical batteries in the lower portion of the body 12, or by other conventional means of ballasting a buoyant object.

A rotary shaft 14 extends from the center of the base 12, the shaft 14 having a distal end 16. A plurality of resilient, open-cell absorbent units or elements 18*a*, 18*b*, and 18*c* are installed along the length of the rotary shaft 14. These absorbent units or elements 18*a* through 18*c* may be formed of natural sponge, synthetic foam plastic material, or the like. The specific material is resilient in order to expand after being compressed, and has an open-cell structure for absorbency. The absorbent elements 18*a* through 18*c* are free to slide or move longitudinally along the length of the rotary shaft 14, subject to constraint by a base plate 20 and a distal or end plate 22 installed upon the shaft 14. These two plates 20 and 22 are immovably affixed longitudinally to the shaft 14 and rotate with the shaft 14, capturing the absorbent elements 18*a* through 18*c* therebetween along the shaft 14.

A reciprocating mechanism comprising diametrically opposed first and second reciprocating rods 24*a* and 24*b* extends from the motorized body 12, the rods 24*a* and 24*b* being substantially parallel to the central rotary shaft 14. The rotary shaft 14 is substantially centered between the two rods 24*a* and 24*b*. The two rods 24*a* and 24*b* do not rotate relative to the motorized body 12, but rather reciprocate opposite one another, i.e., when the rod 24*a* is extending the rod 24*b* is retracting, and vise-versa. Reciprocating operation of the rods 24*a* and 24*b* may be provided by the motor within the motorized body 12 and any suitable conventional mechanism, e.g., a swash plate, rocker arms, bellcranks, etc.

The two rods 24*a*, 24*b* serve to alternately contract and expand the absorbent elements 18*a* through 18*b* along the central rotary shaft 14. This is accomplished by first and second longitudinally reciprocating discs 26*a* and 26*b* disposed along the rotary shaft 14. The first disc 26*a* is positioned between the first and second absorbent elements 18*a* and 18*b*, while the second disc 26*b* is positioned between the second and third absorbent elements 18*b* and 18*c*. The two reciprocating discs 26*a* and 26*b* are rotationally affixed to the rotary shaft 14 by conventional means, e.g., a keyway along the length of the shaft 14 and mating tab or tang serving as a key extending from each disc 26*a*, 26*b*, or the rotating shaft 14 and corresponding passages through the discs 26*a* and 26*b* may be non-circular. The two discs 26*a*, 26*b* thus rotate with the shaft 14 to rotate the absorbent elements 18*a* through 18*c*.

It will be seen that some means must be provided to transfer reciprocating motion from the two non-rotating rods 24*a* and 24*b* to the two rotating discs 26*a* and 26*b*. This is accomplished by first and second rings 28*a* and 28*b* installed respectively about the first and second discs 26*a* and 26*b*. The distal end plate 22 is not attached to either of the non-rotating reciprocating rods, and thus does not require a surrounding ring connecting it to the rods. The first and second rings 28*a* and 28*b* each have a tab 30*a*, 30*b* extending radially therefrom to attach its ring to the respective distal end 32*a* and 32*b* of each of the reciprocating rods 24*a* and 24*b*. The tabs 30*a* and 30*b* are immovably affixed to the respective distal ends 32*a* and 32*b* of the two reciprocating rods 24*a* and 24*b*, and their corresponding rings 28*a* and 28*b* are, thus, also immovably affixed relative to the rods 24*a* and 24*b*. The rings 28*a* and 28*b* reciprocate with the reciprocating motion of the two rods 24 and 24*b*. However, the two discs 26*a* and 26*b* also rotate within their respective rings 28*a* and 28*b* according to the rotary motion of the rotating shaft 14 to which the discs 26*a* and 26*b* are rotationally locked. Thus, the two discs 26*a* and 26*b* both rotate to transfer rotational motion from the central shaft 14 to the absorbent elements 18*a* through 18*c*, and reciprocate with the motion of the two rods 24*a* and 24*b* to compress and expand the absorbent elements.

A base plate ring 34 encircles the base plate 20 in much the same manner as the first and second rings 28*a*, 28*b* surround their respective discs 26*a*, 26*b*. The base plate ring 34 includes two diametrically opposed tabs 36*a* and 36*b* that are not affixed to their respective rods 24*a* and 24*b*, but include passages to allow the rods to slide through the tabs 36*a* and 36*b*. The base plate 20 is immovably affixed to the rotating shaft 14 to rotate therewith, and thus the base plate ring 34 is longitudinally fixed and cannot move with the two reciprocating rods 14*a* and 14*b*. The base plate ring 34 and its base plate 20 serve primarily to stabilize the elongate assembly of the rod 14 and the three absorbent elements 18*a* through 18*c* in order to preclude lateral movement thereof relative to the motorized body 12 and the two reciprocating rods 24*a* and 24*b*.

FIGS. 2A and 2B illustrate the two extremes of the reciprocal motion of the reciprocating rods 24*a* and 24*b*, and thus the discs with their rings 28*a* and 28*b* and the absorbent elements 18*a* through 18*c*. In FIG. 2A, the first rod 24*a* has extended to its maximum length, and the opposite second rod 24*b* is retracted to its minimum length. Alternating extension of the rods 24*a* and 24*b* may be assisted by corresponding springs 38*a* and 38*b* disposed upon the two rods. The extension of the first rod 24*a* increases the span between the base plate 20 (the position is shown by the base plate ring 34 in FIGS. 2A and 2B) and the first disc 26*a* (the position is shown by its associated first disc ring 28*a*). This results in the expansion of the first absorbent element 18*a* to absorb air and water according to its degree of submergence. The simultaneous retraction of the second rod 24*b* draws the second disc 26*b* (the position is shown by the location of the second disc ring 28*b* in FIGS. 2A and 2B) toward the first disc 26*a*, thereby compressing the second absorbent element 18*b* to expel air and water previously absorbed therein. The retraction of the second disc 26*b* draws that disc away from the longitudinally fixed end plate 22, thereby expanding the third absorbent element 18*c* to draw in air and water.

In FIG. 2B, the extension and retraction of the two reciprocating rods 24*a* and 24*b* has been reversed, so that the first rod 24*a* is retracted and the second rod 24*b* is extended. This has the effect of compressing the first absorbent element 18*a* between the base plate 20 and the first disc 26*a*, expelling the previously absorbed air and water. The extension of the second rod 24*b* extends the second disc 26*b* away from the retracted first disc 26*a*, thereby expanding the second absorbent element 18*b* to draw in air and water. The third absorbent element 18*c* is compressed between the extended second disc 26*b* and the longitudinally fixed distal end plate 22, thereby expelling air and water from the third absorbent element.

Simultaneously with the above operation, the central rotary shaft 14 is rotating to rotate the base plate 20, the opposite end plate 22, and the two discs 26*a* and 26*b* therewith. This causes the three absorbent elements 18*a* through 18*c* to rotate as well. Thus, the upper portion of each expanding absorbent element draws in air as it is exposed above the surface of the water, and then rotates 180° about the generally horizontal axis of the rotary shaft 14 to be compressed to expel that air beneath the surface of the water. In the case of the embodiment of FIGS. 1 through 2B, the cylindrical configurations of the absorbent elements 18*a* through 18*b* will result in their absorption of water in the portions disposed beneath the surface, but it will be seen that the absorbed water is expelled above the surface as they rotate and are compressed.

FIG. 3 of the drawings illustrates an alternative embodiment, designated as rotating disc aerator 110. All of the components of the aerator 110 are identical to those corresponding components of the aerator 10 of FIGS. 1 through 2A with the exception of the three absorbent elements 118*a* through 118*c*, and the rotary and reciprocating operation of the device 110 is the same as that described above for the rotating disc aerator 10. The absorbent elements 118*a* through 118*c* of FIG. 3 are of semicylindrical configuration, and are arranged such that they will expand when rotated above the surface of the water to draw in air, and contract when rotated below the surface to expel that air into the water. The elimination of half of each of the absorbent elements 118*a* through 118*c* minimizes the absorption of water as the elements 118*a* through 118*c* rotate.

Figure 4:
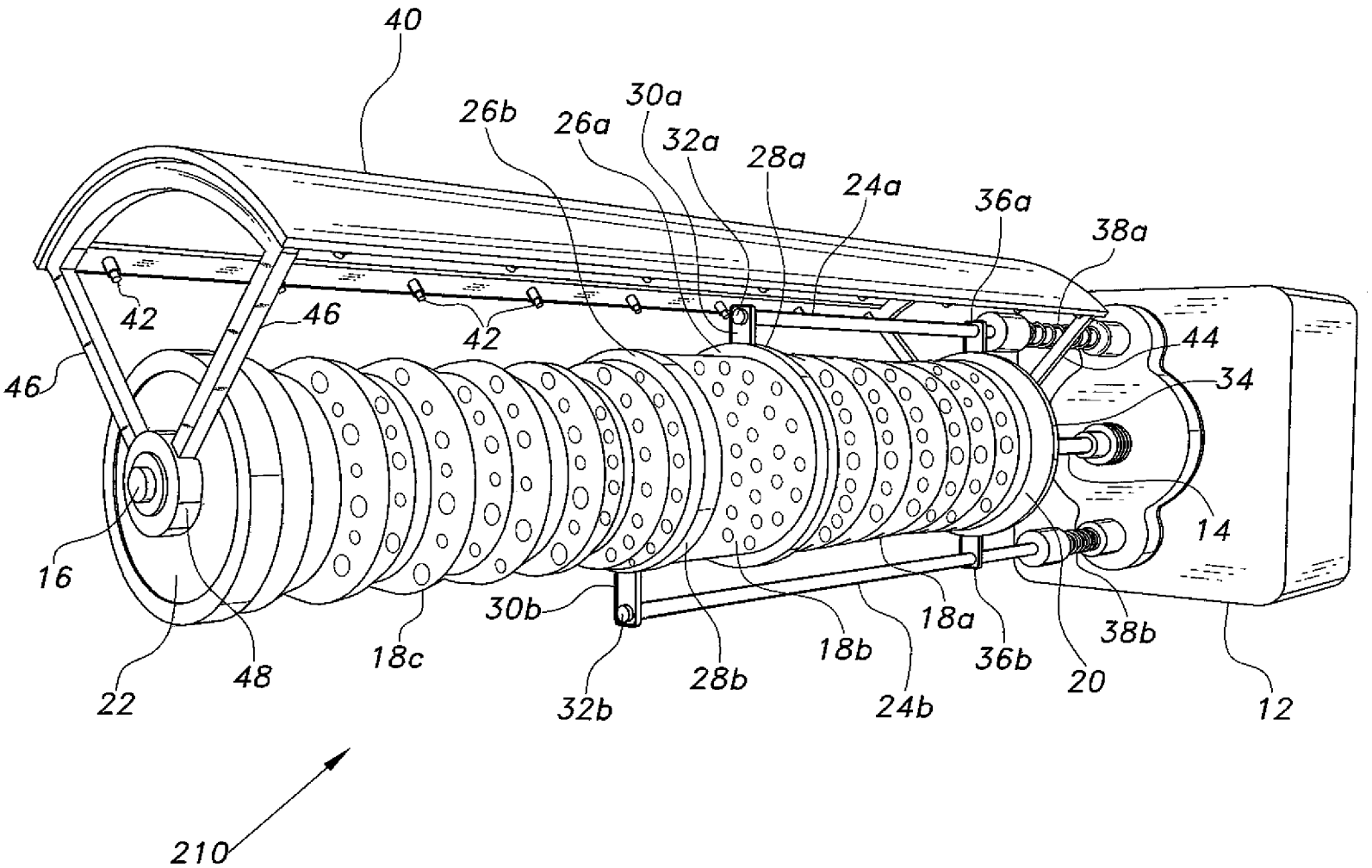
FIG. 4 is a perspective view of another alternative embodiment of a rotating disc aerator according to the present invention, illustrating various features thereof.

FIG. 4 of the drawings illustrates a further alternative embodiment, designated as rotating disc aerator 210. All of the components of the aerator 210 are identical to those corresponding components of the aerator 10 of FIGS. 1 through 2A, and the rotary and reciprocating operation of the device 210 is the same as that described above for the rotary disc aerator 10. However, the rotating disc aerator 210 includes an overhead spray guard 40 disposed above the three absorbent elements 18*a* through 18*c*, and a plurality of spray nozzles 42 are disposed therebeneath. The spray nozzles 42 serve to rinse any contamination (e.g., oil residue, algae, etc.) from the surfaces of the three absorbent elements 18*a* through 18*c* as they rotate beneath the guard 40 and nozzles 42. The spray guard 40 is maintained in a position above the absorbent elements 18*a* through 18*c* by a pair of base support struts 44 affixed to the rotationally stationary base ring 34 or other non-rotating component, and a pair of distal end support struts 46 that are, in turn, supported on a bearing 48 disposed upon the distal end portion 16 of the rotary shaft 14. The shaft 14 rotates within the bearing 48, the outer shell of the bearing remaining rotationally stationary to support the shield end struts 46, and thus the distal end of the spray guard 40.

Figure 5:
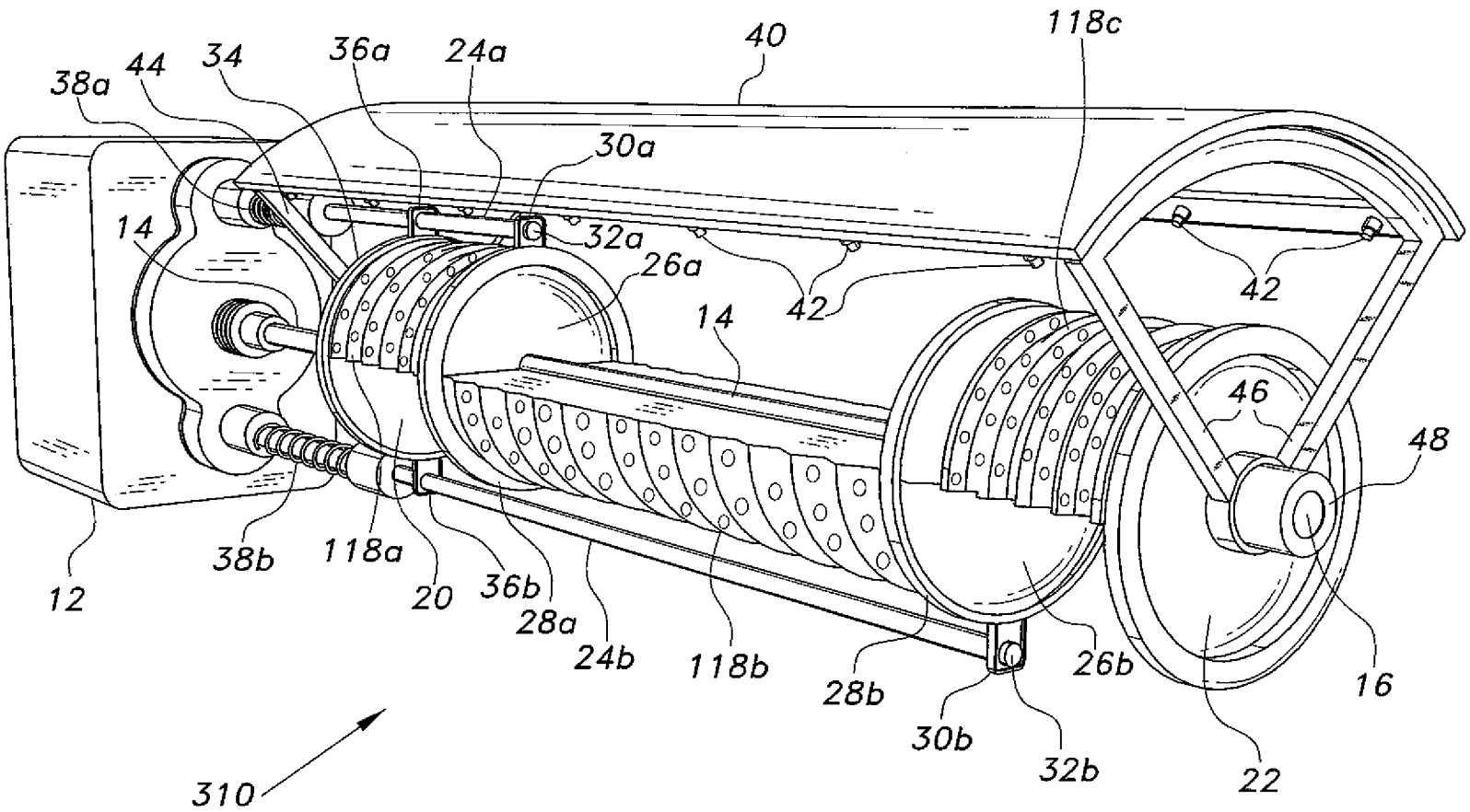
FIG. 5 is a perspective view of yet another alternative embodiment of a rotating disc aerator according to the present invention, which combines certain features of the rotating disc aerators of FIGS. 3 and 4.

FIG. 5 is an illustration of an additional embodiment, designated as rotating disc aerator 310. The aerator embodiment 310 combines features of the aerator 110 of FIG. 3 and the aerator 210 of FIG. 4. All of the components of the aerator 310 are identical to those corresponding components of the aerator 210 of FIG. 4, with the exception of the three absorbent elements 118*a* through 118*c* that are identical to those elements shown for the embodiment 110 of FIG. 3. The rotary and reciprocating operation of the device 310 is the same as that described above for the rotating disc aerator 210 of FIG. 4, the spray nozzles 42 beneath the spray guard 40 serving to wash or rinse contamination from the exposed absorbent elements 118*a* through 118*c* as they rotate above the water.

It is to be understood that the present invention is not limited to the embodiments described above, but encompasses any and all embodiments within the scope of the following claims.

I claim:

1. A rotating disc aerator, comprising:

a motorized base;

a centrally disposed rotary shaft extending from the base;

at least one absorbent element of resilient open-cell material captured upon the rotary shaft and rotating therewith; and a reciprocating mechanism extending from the base, the reciprocating mechanism alternately compressing and expanding each one of the at least one absorbent element.

2. The rotating disc aerator according to claim 1 further comprising a plurality of discs rotationally affixed to the rotary shaft, the at least one absorbent element being captured between the discs.

3. The rotating disc aerator according to claim 2, wherein the reciprocating mechanism comprises diametrically opposed first and second oppositely reciprocating rods extending from the base parallel to the rotary shaft, the rotary shaft being disposed between the rods, each of the rods having a distal end, one of the discs being retained by the distal end of each of the rods and reciprocating therewith, wherein the discs alternately compressing and expanding the absorbent element as the rods reciprocate.

4. The rotating disc aerator according to claim 3 further comprising a ring disposed around each of the discs, each of the discs rotating within the respective ring as the rotary shaft rotates, each of the rings being attached to the distal end of one of the reciprocating rods.

5. The rotating disc aerator according to claim 1 further comprising a plurality of spray nozzles and a spray guard disposed above the rotary shaft, the absorbent element, and the reciprocating mechanism.

6. The rotating disc aerator according to claim 1 wherein the at least one absorbent element has a semicylindrical configuration.

7. The rotating disc aerator according to claim 1 wherein said at least one absorbent element comprises three absorbent elements.

8. A rotating disc aerator, comprising:

a motorized base;

a centrally disposed rotary shaft extending from the base;

at least one absorbent element of resilient open-cell material captured upon the rotary shaft and rotating therewith;

a plurality of discs rotationally affixed to the rotary shaft, the at least one absorbent element being captured between the discs; and a reciprocating mechanism extending form the base, the reciprocating mechanism communicating with the discs, the discs alternately compressing and expanding the absorbent element as the mechanism reciprocates.

9. The rotating disc aerator according to claim 8, wherein the reciprocating mechanism comprises diametrically opposed first and second oppositely reciprocating rods extending from the base parallel to the rotary shaft, the rotary shaft being disposed between the rods, each of the rods having a distal end, one of the discs being retained by the distal end of each of the rods and reciprocating therewith, the discs alternately compressing and expanding the absorbent element as the rods reciprocate.

10. The rotating disc aerator according to claim 9, further comprising a ring disposed around each of the discs, each of the discs rotating within the respective ring as the rotary shaft rotates, each of the rings being attached to the distal end of one of the rods.

11. The rotating disc aerator according to claim 8, further comprising a plurality of spray nozzles and a spray guard disposed above the rotary shaft, the absorbent element, and the discs.

12. The rotating disc aerator according to claim 8, wherein said at least one absorbent element has a semicylindrical configuration.

13. The rotating disc aerator according to claim 8, where said at least one absorbent element comprises three absorbent elements.

14. A rotating disc aerator, comprising:

a motorized base;

a centrally disposed rotary shaft extending from the base;

at least one absorbent element of resilient open-cell material captured upon the rotary shaft and rotating therewith; and diametrically opposed first and second oppositely reciprocating rods extending from the base parallel to the rotary shaft, the rotary shaft being disposed between the rods, the rods alternately compressing and expanding the at least one absorbent element.

15. The rotating disc aerator according to claim 14, further comprising a plurality of discs rotationally affixed to the rotary shaft, the at least one absorbent element being captured between the discs.

16. The rotating disc aerator according to claim 15, wherein each of the rods has a distal end, one of the discs being retained by the distal end of each of the rods and reciprocating therewith, the discs alternately compressing and expanding the absorbent element as the rods reciprocate.

17. The rotating disc aerator according to claim 16, further comprising a ring disposed around each of the discs, each of the discs rotating within the respective ring as the rotary shaft rotates, each of the rings being attached to the distal end of one of the rods.

18. The rotating disc aerator according to claim 14, further comprising a plurality of spray nozzles and a spray guard disposed above the rotary shaft, the absorbent element, and the reciprocating rods.

19. The rotating disc aerator according to claim 14, wherein said at least one absorbent element has a semicylindrical configuration.

* * * * *